United States Patent [19]

Skillman

[11] Patent Number: 4,688,838

[45] Date of Patent: Aug. 25, 1987

[54] TWISTER BOBBIN LIFTER AND CARRIER

[75] Inventor: Ernest F. Skillman, Greensboro, N.C.

[73] Assignee: Burlington Industries, Inc., Greensboro, N.C.

[21] Appl. No.: 835,748

[22] Filed: Mar. 3, 1986

[51] Int. Cl.[4] ..... B66C 1/54

[52] U.S. Cl. ..... 294/67.5; 294/15; 57/275

[58] Field of Search ..... 294/67.5, 67.32, 67.31, 294/67.4, 67.41, 15; 57/267, 266, 270, 275, 276

[56] References Cited

U.S. PATENT DOCUMENTS

| | | | |
|---|---|---|---|
| 366,348 | 7/1887 | Seabury | 294/15 |
| 2,348,309 | 5/1944 | Rohr | 294/78 |
| 2,399,360 | 4/1946 | Lacey | 294/78 |
| 2,820,999 | 1/1958 | Meltzer et al. . | |
| 3,350,868 | 11/1967 | Winter | 57/275 |
| 4,324,094 | 4/1982 | Cicerone | 57/267 |

*Primary Examiner*—James B. Marbert

*Attorney, Agent, or Firm*—Nixon and Vanderhye

[57] ABSTRACT

Easy lifting and transportation of a twister bobbin, and movement of the bobbin onto a creel pin of a warper creel, is facilitated. A bridle has an eye disposed at its top, the eye receiving a hook connected to a powered lift. A generally semi-circular sheet metal body receives a bobbin body therein, the sheet metal body being pivotally mounted to the bridle for rotation about a horizontal axis. A yoke is rigidly connected to the body and terminates in a semi-circular portion which fits in a groove in the bobbin nose. A handle is connected to the yoke termination and extends at an acute angle to the dimension of elongation of the body and yoke. By grasping the handle an operator can pivot a bobbin mounted by the device from a vertical to a horizontal position, control the lift to move the bobbin into place with respect to a creel, and move the bobbin onto a horizontally extending creel pin.

20 Claims, 5 Drawing Figures

TWISTER BOBBIN LIFTER AND CARRIER

BACKGROUND AND SUMMARY OF THE INVENTION

In many textile operations it is necessary to lift and load bobbins of yarn onto various bobbin-mounting structures. For instance filling pin racks, pin trucks, and warper creels all have bobbin supporting pins. In order to place a full bobbin into operative association with the pins, it is necessary to lift the bobbin, rotate it into a position in which it is in alignment with the pin, and then place the bobbin over the pin. Textile facilities typically employ women operators to perform the bobbin loading operations.

Many bobbin loading operations can be performed manually without significant difficulties. However some bobbins that are conventionally utilized are too heavy to be safely and effectively lifted, transported, and loaded by hand. For instance twister bobbins loaded onto warper creels often have weights in excess of 20 pounds, and lifting and loading of the bobbins by female operators into a warper creel at heights ranging from 12 inches to 84 inches is impractical. Therefore it is desirable to have an aide to facilitate manual lifting, transporting, and loading of bobbins onto warper creels, or like structures.

According to the present invention, an apparatus is provided which enables large fiberglass twister bobbins to be practically handled by female operators and lifted, transported, and loaded onto warper creel pins or the like. The apparatus according to the invention comprises a bridle which is connected to a powered lifting device, such as a crane or a lift truck. The controls for the lifting device are readily accessible to the operator, such as being provided at a position just above the hook for the lifting device which engages the bridle.

The bridle is pivotally connected to a generally semi-circular open body which receives a bobbin. The body typically is formed of sheet metal, and is pivotally connected to the bridle for rotation about a horizontal axis, with the axis being disposed slightly above the bobbin-body combination center of gravity. A lug connected to the body stops the movement of the body in a position in which it extends vertically.

Extending from the body and in alignment therewith is a yoke, the yoke terminating in a generally semi-circular termination which is dimensioned to be disposed in the groove in a bobbin nose. A handle is connected to the yoke and extends away from the end termination, and then at an acute angle with respect to the dimension of elongation of the body and yoke.

An operator may simply and effectively utilize the device to lift, transport, and load bobbins first by, while the body and yoke are disposed in a generally vertical position, moving them sideways into operative association with a bobbin so that the device body receives the bobbin body, and the yoke is disposed in the groove of the bobbin nose, and then controlling the powered lift to lift the bobbin vertically upwardly to a desired transporting position. Lifting of the yoke effects lifting of the bobbin due to the inter-engagement between the yoke and the bobbin nose groove. Then using the handle, the operator pivots the body and yoke approximately 90° about the horizontal axis while controlling the powered lift to move the bobbin to a mounting position. The bobbin is moved over a generally horizontally extending pin (such as a creel pin) at the mounting position, and then lift is controlled, and the handle is manipulated, to move the device body and yoke downwardly out of engagement with the bobbin, and then away from the bobbin. In this way with a minimum of physical exertion, and with maximum safety, an operator can efficiently load even heavy bobbins.

It is the primary object of the present invention to provide a method and apparatus for facilitating effective lifting, transportation, and loading of bobbins and the like. This and other objects of the invention will become clear from an inspection of the detailed description of the invention, and from the appended claims.

DETAILED DESCRIPTION OF THE DRAWINGS

Figure 4:
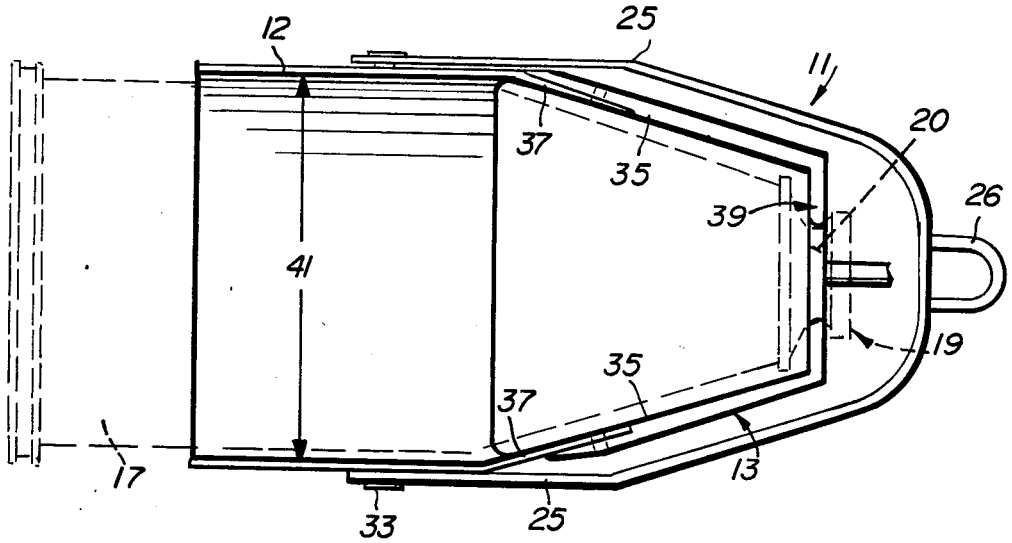
FIG. 4 is an end view of the device of FIG. 1 disconnected from the lift, with the bobbin shown in dotted line, and with the handle cut away for clarity of illustration.

Exemplary apparatus according to the present invention is shown generally by reference numeral 10 in the drawings. Major components of the apparatus include the bridle 11, the body 12, the yoke 13, and the handle 14. The apparatus 10 is specifically designed and constructed for lifting, transporting, and loading bobbins, such as the bobbin 16. Note that the bobbin 16 has a body portion 17 which tapers conically inwardly (see reference numeral 18) toward a nose 19. As seen perhaps most clearly in FIG. 4, the nose 19 has means defining a circular groove 20 therein. The end 21 of the bobbin 16 opposite the nose 19 is adapted to be mounted over a generally horizontally extending pin, such as the creel pin 22 in FIG. 2.

The bridle 11 preferably is formed of bar stock, or like metal, and has a pair of arms 25 that are open at one end thereof, and closed at the other end, at the closed end an eyelet 26, or like structure, being provided which is adapted to receive a hook 27 which is operatively connected to a conventional powered lifting device (not shown), such as a crane or fork lift. At the ends thereof, the bridle arms 25 have means defining an opening 29 therein.

Figure 5:
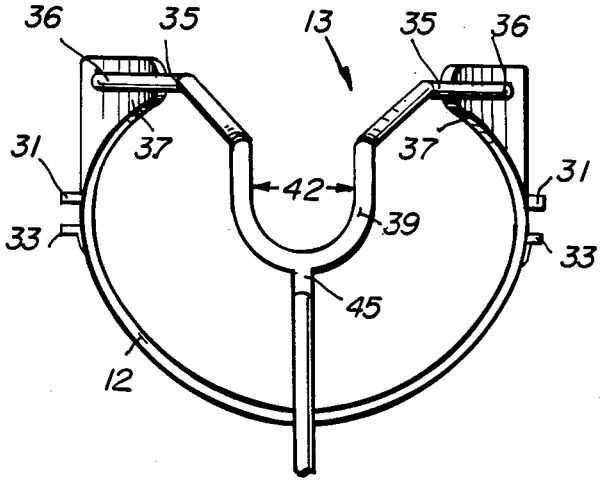
FIG. 5 is a top plan view of the device of FIG. 4 with the bridle removed for clarity of illustration, and again with the handle cut away.

The body 12 preferably comprises a piece of sheet metal which is bent so that it has a generally semi-circular configuration (actually preferably between a semicircle and a "U", as perhaps best seen in FIG. 5). A piece of sheet metal is bent to form a generally half tubular member which is elongated in a first dimension 30. The body 12 has a pair of pivot posts 31, best seen in FIG. 5, which extend outwardly therefrom in a dimension transverse to the first dimension 30. The pivot posts 31 are received by the openings 29 in the ends of the bridle arms 25, the openings 29 and pivot posts 31 mounting the body 12 for pivotal movement of the body 12 with respect to the bridle 11 at least about 90°.

In normal use since the bridle 11 will be hanging downwardly from a hook 27, the posts 31 and openings 29 define a pivot axis which is generally horizontal. Also, the posts 31 are preferably positioned with respect to the body 12 so that the axis of rotation of the body 12 with respect to the bridle 11 during use will be slightly above the center of gravity of the combination of the bobbin 16 and the body, yoke, and handle 12–14. In this way, the bobbin-body combination will normally assume the position illustrated in FIG. 1 in which the bobbin 16 is generally vertically disposed, as are the body 12 and the yoke 13.

Figure 1:
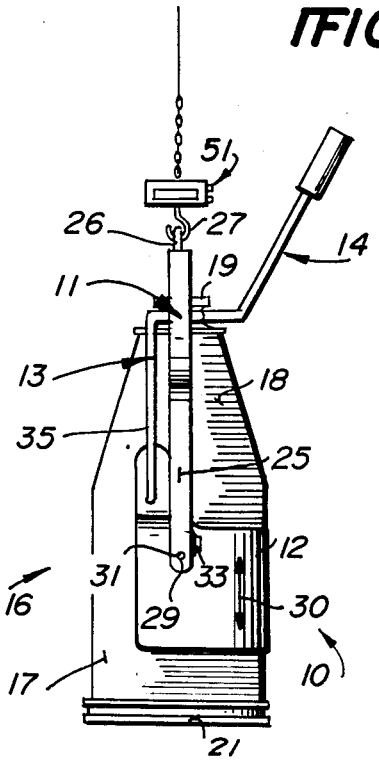
FIG. 1 is a side view showing a lifting device according to the present invention in operative association with a bobbin in a position providing effective lifting of the bobbin.

It is also desirable to stop the movement of the body 12 with respect to the bridle 11 in the position illustrated in FIG. 1. For that purpose, a pair of lugs 33 are provided which are integral with the body 12 and extend outwardly therefrom at a position adjacent the pivot posts 31. The lugs 33 engage the bridle 11 when the body 12 reaches the position with respect to the bridle 11 wherein the bobbin 16 is in complete alignment with the bridle 11, yet allow free pivotal movement of the bobbin to generally horizontal transporting (FIG. 3) and loading (FIG. 2) positions.

Extending outwardly from the body 12 generally in the dimension 30 is the yoke 13. The yoke 13 preferably is formed of generally circular cross-section metal rod (e.g. stainless steel, compatible with the stainless steel sheet metal forming body 12). This rod includes a pair of arms 35 each connected at a free end 36 thereof to a connector portion of the body 12. The connector portions 37 of the body 12, as best seen in FIG. 5, taper inwardly (as do the arms 35) with substantially the same taper as the taper of the conical portion 18 of the bobbin 16. The arms 35 terminate in a generally semi-circular termination 39. Note that the termination 39 which also is preferably between a semi-circle and a "U" is spaced from but generally parallel to the body 12. The body 12 and the termination 39 are specifically dimensioned to receive the bobbin 16 therein. That is, the diameter 41 (see FIG. 4) of the body 12 is greater (preferably only slightly greater) than the outside diameter of the body portion 17 of the bobbin, while the diameter 42 (see FIG. 5) of the yoke termination 39 is approximately the same as the diameter of the nose 19 of the bobbin at the groove 20. In particular see FIG. 4 which shows the termination 35 disposed in the groove 20.

Figure 3:
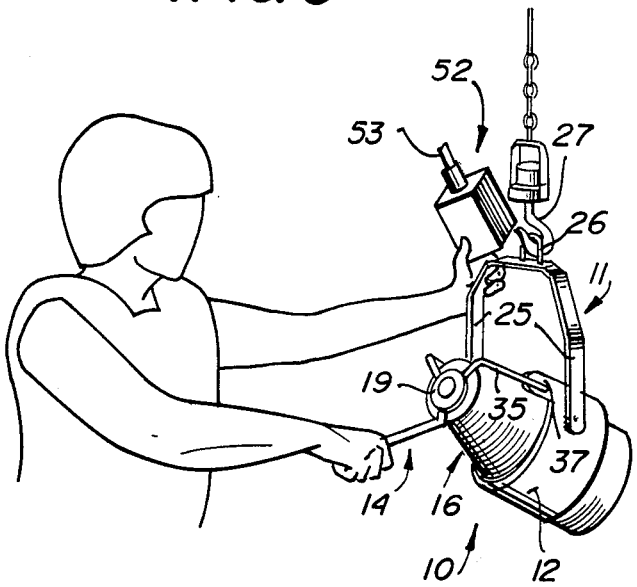
FIG. 3 is a perspective view of the device of FIGS. 1 and 2 showing an operator grasping the handle during transportation of the bobbin, and showing the operator using a different lift control mechanism than is provided for the device of FIGS. 1 and 2.
Figure 2:
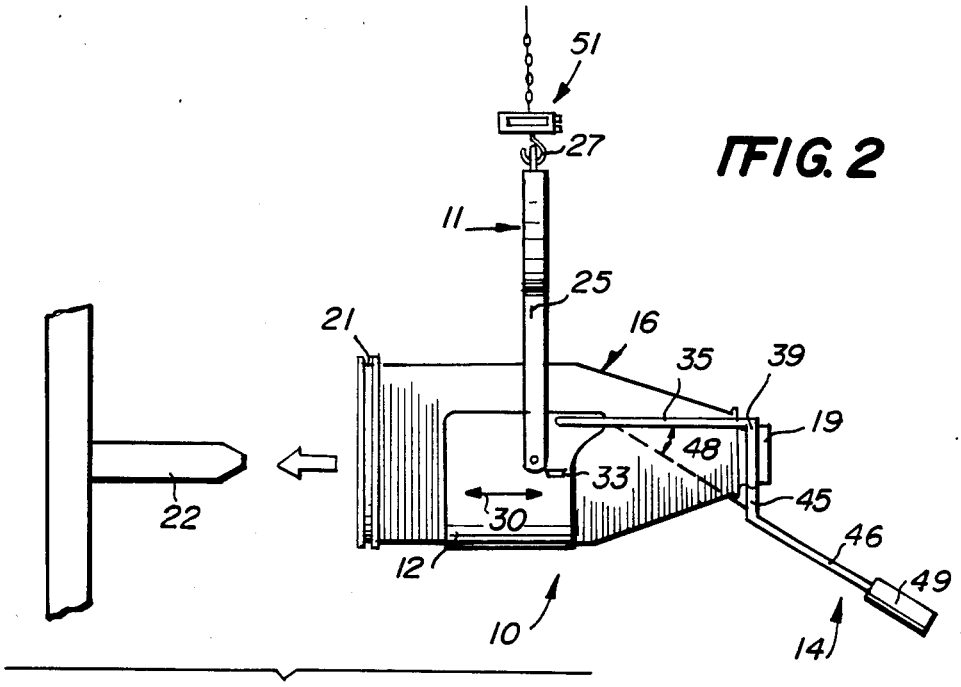
FIG. 2 is a side view of the device of FIG. 1 shown in another position in which the bobbin is about to be placed over a creel pin.

Due to the cooperation between the termination 39 of the yoke 13 and the groove 20 of the bobbin nose 19, the device 10 engages the bobbin 16 in such a way that lifting of the device 10 effects lifting of the bobbin 16. The body 12 supports the bobbin 16 when they are pivoted away from the vertical position of FIG. 1 to the transporting and loading positions, as illustrated in FIGS. 2 and 3.

In order to facilitate utilization of the device 10, the handle 14 is provided. As illustrated in the drawings, the preferred construction of the handle 14 is to form it of stainless steel rod of the same diameter as the rod forming the yoke 13. The rod forming the handle 14 includes a first portion 45 which is integral with (e.g. welded to) the yoke termination 39 extending outwardly therefrom (downwardly in the position illustrated in FIGS. 2 and 5), and then having a portion 46 which extends at an acute angle with respect to the dimension 30. This angle, shown by reference numeral 48 in FIG. 2, preferably is about 30°. In order to facilitate utilization of the handle 14, it preferably has an enlarged end termination portion 49 which is readily grasped by the operator (see FIG. 3). Preferably the enlarged end termination 49 is of wood, plastic, or like material.

In order to facilitate control of the lift mechanism for lifting the hook 27, it is desirable to provide the controls 51 (see FIGS. 1 and 2) for the lifts so that they are just above the hook 27. In this position they may be easily manipulated by an operator who is also grasping the handle 14. However the controls 51 need not be provided in that position; for instance they may be provided in a conventional control box 52 (see FIG. 3) which is connected by a free swinging cable 53 to the powered lift.

The device 10 may be readily and efficiently utilized to transport bobbins 16 in a safe and efficient manner. A typical method of utilization or operation thereof is as follows:

With the body 12 in the position illustrated in FIG. 1 in which the stops 33 engage the bridle 11 arms 25, the device 10 is moved sideways by the operator into a position operatively engaging a bobbin 16. Typically a plurality of bobbins 16 would be mounted in an open-topped container, and the device 10 would be lowered into the container in alignment with the bobbin 16, and then moved sidewards by the operator so that the yoke termination 39 engages the groove 20, and the body 12 engages the bobbin body 17. Then the operator operates the controls (51, 52) for the powered lift to lift the bobbin 16 vertically upwardly. Lifting of the device 10, through the hook 27 and eyelet 26, effects lifting of the bobbin 16 due to the engagement between the yoke termination and the groove 20.

Once the bobbin 16 has been lifted, the operator uses the handle 14, as illustrated most clearly in FIG. 3, to pivot the body 12 and yoke 13 about the horizontal axis defined by the pivot posts 31 and the openings 29, this pivotal movement being roughly 90° (e.g. about 70° as illustrated in FIG. 3). In this position the bobbin 16 is supported by both the yoke termination 39 and the body 12. Also in this position the operator controls the powered lift, again utilizing controls 51, 52, to move the bobbin to a mounting position.

At the mounting position, illustrated in FIG. 2, the bobbin 16 is moved generally horizontally (i.e. 90° from the position in FIG. 1) over the horizontally extending creel pin 22. In this position the operator has grasped the handle 14 to move it so that the bobbin 16 is essentially completely horizontal, and then controls the powered lift and the handle to move the bobbin horizontally over the pin 22. Once the bobbin 16 has been mounted on the pin 22, the lift is again controlled, and the handle 14 manipulated, to move the device 10 downwardly out of engagement with the bobbin (that is, so that the yoke termination 39 is no longer in groove 20 and the body 12 no longer engages bobbin body 17). Then the lift is again controlled to move the device 10 away from the bobbin 16, and the operation can be repeated until all creel pins 22 are loaded with bobbins 16.

It will thus be seen that according to the present invention an efficient, simple, and effective method and apparatus are provided for lifting, transporting, and loading bobbins. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A lifting and transporting apparatus comprising:

a bridle;

a body comprising a generally semi-circular tubular member elongated in a first dimension;

means for pivotally mounting said body to said bridle for rotation about an axis generally transverse to said first dimension;

a yoke rigidly connected to said body, said yoke including a pair of arms extending generally away from said body and connected together in a generally semi-circular termination at a location remote from said body; and a handle rigidly connected to said yoke.

2. Apparatus as recited in claim 1 further comprising a lug extending outwardly from said body spaced from said pivotal mounting means, said lug comprising means for stopping pivotal movement of said body in the position in which said first dimension is in alignment with a dimension of elongation of said bridle.

3. Apparatus as recited in claim 2 wherein said means for pivotally mounting said body to said bridle mounts said body for rotation of at least 90° from the position in which said lug abuts said bridle with said first dimension aligned with a dimension of elongation of said bridle.

4. Apparatus as recited in claim 1 wherein said yoke comprises a pair of arms connected at first ends thereof to said body, and extending therefrom generally in said first dimension, said generally semi-circular termination being spaced from, but parallel to, said generally semi-circular tubular body, and having a radius significantly less than the radius of said generally semi-circular tubular body.

5. Apparatus as recited in claim 1 further comprising an eye means for operative attachment to a lift hook, said eye means rigidly connected to said bridle at the portion thereof most remote from said body.

6. Apparatus as recited in claim 1 wherein said means for pivotally mounting said body to said bridle comprises a pair of pivot posts extending outwardly from said body in a dimension generally transverse to said first dimension, and integral with said body; and means defining openings in end portions of said bridle, said openings receiving said pivot posts therein.

7. A bobbin lifting and transporting device for lifting and transporting a bobbin having a bobbin body with an inwardly tapering conical top terminating in a nose, said nose having means defining a groove; said device comprising:

a bridle for connection to a powered lifting device;

an open sided generally semi-circular body having an inside diameter greater than the outside diameter of said bobbin body;

means for pivotally mounting said body to said bridle;

a yoke connected to said body and having a generally semi-circular termination, said termination dimensioned to fit into said groove to support said bobbin nose and effect lifting of said bobbin; and a handle operatively connected to the rest of said device for grasping by an operator for effecting rotation of said yoke and body with respect to said bridle.

8. Apparatus as recited in claim 7 wherein said pivotally mounting means comprises means defining a pivot axis which is slightly closer to the nose of said bobbin than the center of gravity of the combination of the bobbin, the device body, the yoke, and the handle, so that without action by an operator grasping said handle, said body and yoke tend to assume a position in which said bobbin is in alignment with said bridle.

9. A device as recited in claim 8 further comprising a lug stop operatively connected to said body, and cooperating with said body and said bridle to stop said body in a position in which said bobbin is in alignment with said bridle.

10. A device as recited in claim 7 wherein said yoke comprises a pair of arms each connected to a connector portion of said body, and wherein said connector portions of said body and said arms taper inwardly from said body towards said yoke termination with substantially the same taper as the conical inward taper of said bobbin.

11. A device as recited in claim 10 wherein said body is constructed of sheet metal, and said yoke and handle are constructed of generally circular cross-section metal rod.

12. A device as recited in claim 11 wherein said pivotal mounting means comprises a pair of metal posts integral with and extending outwardly from said device body; and means defining a pair of openings in said bridle, each opening receiving a pivot post therein.

13. A device as recited in claim 11 wherein said handle comprises a rod extending outwardly from said yoke termination, and then at an acute angle to a dimension of elongation of said bobbin and device body.

14. A device as recited in claim 13 wherein said handle comprises an enlarged end termination, and wherein said acute angle is an angle of approximately 30°.

15. A device as recited in claim 7 connected to a powered lifting device by a hook which operatively engages said bridle, and control means provided just above said hook for controlling said powered lifting device.

16. Apparatus as recited in claim 10 wherein said pivotally mounting means comprises means defining a pivot axis which is slightly closer to the nose of said bobbin than the center of gravity of the combination of the bobbin, the device body, the yoke, and the handle, so that without action by an operator grasping said handle, said body and yoke tend to assume a position in which said bobbin is in alignment with said bridle.

17. A device as recited in claim 16 further comprising a lug stop operatively connected to said body, and cooperating with said body and said bridle to stop said body in a position in which said bobbin is in alignment with said bridle.

18. A lifting and transporting apparatus comprising:

a bridle;

a body comprising a generally semi-circular tubular member elongated in a first dimension;

means for pivotally mounting said body to said bridle for rotation about an axis generally transverse to said first dimension;

a yoke rigidly connected to said body; and a handle rigidly connected to said yoke, said handle comprising a rod extending outwardly from said termination and then at an acute angle to said first dimension, and away from said body.

19. Apparatus as recited in claim 18 wherein said handle comprises an enlarged end termination, and wherein said acute angle is an angle of approximately 30°.

20. A method of lifting and transporting a bobbin having a body and an inwardly tapering conical top terminating in a nose, the nose having means defining a groove therein, the method utilizing a device having a bridle connected to a powered lift, a body pivotally connected to the bridle for pivotal movement about a horizontal axis, a yoke, and a handle operatively connected to the yoke and body, comprising the steps:

(a) while the body and yoke are disposed in a generally vertical position, moving them sideways into operative association with the bobbin so that the body receives the bobbin body and the yoke is disposed in the groove;

(b) controlling the powered lift to lift the bobbin vertically upwardly to a desired transporting position, lifting of the yoke effecting lifting of the bobbin due to the inter-engagement between the yoke and nose groove;

(c) using the handle, pivoting the body and yoke about the horizontal axis so that the bobbin moves toward a generally horizontal position, while controlling the powered lift to move the bobbin to a mounting position;

(d) moving the bobbin over a generally horizontally extending pin disposed at the mounting position so that the bobbin is mounted by the pin; and (e) after (d), controlling the lift and handle to move the device body and yoke downwardly out of engagement with the bobbin, and then away from the bobbin.

* * * * *